US010875745B2

(12) United States Patent
Boros

(10) Patent No.: US 10,875,745 B2
(45) Date of Patent: Dec. 29, 2020

(54) HANDRAIL-DRIVE SYSTEM WITH DRIVE ELEMENTS INTEGRATED IN THE HANDRAIL

(71) Applicant: INVENTIO AG, Hergiswil (CH)

(72) Inventor: Csaba Boros, Dunajska Streda (SK)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 16/634,738

(22) PCT Filed: Jul. 25, 2018

(86) PCT No.: PCT/EP2018/070169
§ 371 (c)(1),
(2) Date: Jan. 28, 2020

(87) PCT Pub. No.: WO2019/029992
PCT Pub. Date: Feb. 14, 2019

(65) Prior Publication Data

US 2020/0207587 A1 Jul. 2, 2020

(30) Foreign Application Priority Data

Aug. 10, 2017 (EP) ..... 17185725

(51) Int. Cl.
*B66B 23/04* (2006.01)
*B66B 23/02* (2006.01)

(52) U.S. Cl.
CPC ..... *B66B 23/04* (2013.01); *B66B 23/024* (2013.01)

(58) Field of Classification Search
CPC ..... B66B 23/06; B65G 23/04; B65G 23/24
See application file for complete search history.

(56) References Cited

U.S. PATENT DOCUMENTS 3,749,224 A * 7/1973 Engeler ..... B66B 23/04 198/331
3,865,225 A * 2/1975 Phal ..... B66B 23/24 198/337

(Continued)

FOREIGN PATENT DOCUMENTS

CN 201065298 5/2008
JP H07267562 A 10/1995

(Continued)

OTHER PUBLICATIONS

International Search Report for International Application No. PCT/EP2018/070169 dated Nov. 30, 2018.

*Primary Examiner* — Mark A Deuble
(74) *Attorney, Agent, or Firm* — Knobbe Martens Olson & Bear LLP

(57) ABSTRACT

The application relates to a handrail-drive system of an escalator. The handrail-drive system includes a handrail drive with drive elements and a belt-form handrail which can be moved in a circulatory manner. The handrail is delimited by an outer contour configured as a gripping surface and by an inner contour which leaves a cavity free in the handrail. The driving force is transmitted from the drive elements to the handrail on two mutually opposite side surfaces of the inner contour, wherein a complementary configuration of the side surfaces makes it possible for all the other forces which are caused by the transmission of the driving force and act between the side surfaces to compensate for one another.

16 Claims, 7 Drawing Sheets

(56) References Cited

U.S. PATENT DOCUMENTS

| | | | | |
|---|---|---|---|---|
| 5,259,492 | A | 11/1993 | Jaminet | |
| 7,243,775 | B2 | 7/2007 | Novacek et al. | |
| 7,562,759 | B2 * | 7/2009 | Guo | B66B 23/04 198/335 |
| 7,594,570 | B2 * | 9/2009 | Miessbacher | B66B 23/02 198/335 |
| 2005/0173224 | A1 | 8/2005 | Caunce | |
| 2007/0029163 | A1 * | 2/2007 | Aulanko | B66B 23/04 198/335 |
| 2016/0016760 | A1 * | 1/2016 | Srb-Gaffron | B66B 23/20 198/336 |
| 2019/0039861 | A1 * | 2/2019 | Vlasak | B66B 23/04 |

FOREIGN PATENT DOCUMENTS

| | | | |
|---|---|---|---|
| JP | 2004115267 | A | 4/2004 |
| WO | WO 03/066500 | A1 | 2/2002 |
| WO | WO 2004/35451 | A1 | 4/2004 |

* cited by examiner

HANDRAIL-DRIVE SYSTEM WITH DRIVE ELEMENTS INTEGRATED IN THE HANDRAIL

TECHNICAL FIELD

The present application relates to a handrail-drive system for an escalator or a moving walkway. The handrail-drive system has a handrail drive with drive elements and a belt-form handrail which can be moved in a circulatory manner.

SUMMARY

WO 200435451 A1 discloses a linear drive system for handrails with a multi-wedge profile (multiple-spline profile). An essential element of the drive system is a drive belt which has a toothed belt profile on its inner side facing away from the handrail. On its outer side facing the multi-wedge profile, the drive belt has a counter profile corresponding to the multi-wedge profile. By means of said counter profile, the drive power is transmitted to the handrail. This solution is disadvantageous because of significant signs of wear on the wedge profile edges and the need for pressure rollers that press the multi-wedge profile of the handrail against the multi-wedge profile of the drive belt. The use of the aforementioned handrail-drive system requires a specific installation space which severely restricts the possible installation positions of the drive elements in the area of the circulating handrail of the escalator or the moving walkway.

Among others, there can be a need for a handrail-drive system, whose drive elements can be installed at virtually any desired installation position within the escalator or the moving walkway.

Such a need can be met by a handrail-drive system of an escalator or a moving walkway, said handrail-drive system having at least one handrail drive with drive elements and a belt-form handrail which can be moved in a circulatory manner. The handrail is delimited by an outer contour, which is configured in the form of a gripping surface, and by an inner contour, which leaves a cavity free in the handrail, wherein the cavity is open toward the surroundings of the handrail. As a result, the handrail can be produced in a material-saving manner. The handrail-drive system is preferably configured as a linear handrail-drive system, i.e., in the area of the drive elements, the handrail is guided past said drive elements in an essentially straight manner, and the drive elements which are in direct contact with the handrail are arranged in one plane. The driving force is transmitted from the drive elements to the handrail on two mutually opposite side surfaces of the inner contour, wherein, due to a complementary configuration of the side surfaces, and with the exception of the driving force, all the other forces which are caused by the transmission of the driving force and act between the side surfaces are compensated for one another.

According to one aspect, it is proposed that the handrail is made of a soft-elastic elastomeric material and has sliding elements made of a polymer material which is harder than the soft-elastic elastomeric material. In sections, the sliding elements are arranged at discrete distances along the longitudinal extension of the handrail, wherein guide elements and/or tooth profiles are formed on the sliding elements.

With regard to the present application, a complementary configuration of the side surfaces refers to a configuration which, with the exception of the driving force, mutually compensates the forces acting on side surfaces in the area of the driving force transmission, and so no additional components, for example, pressure rollers, are required. The two complementarily configured side surfaces are mirror-symmetrical to one another. In a handrail, which is operationally arranged in a circulatory manner, said side surfaces can be, for example, two side surfaces arranged in vertical planes parallel to one another which mutually support the pressing force required for transmitting the driving force between the handrail and the drive elements.

Possible features and advantages of embodiments of the invention can be considered, among others, to be based on ideas and findings described below.

According to a further aspect, the handrail can have a U-shaped or C-shaped cross-section along its longitudinal extension. In such case, the two side surfaces can be arranged on the two mutually opposite sides of the inner contour of the two legs of the U-shaped or C-shaped cross-section. A center ridge formed in the inner contour, which extends in the longitudinal direction of the handrail and on which the two side surfaces are formed, is also possible. The side surfaces do not necessarily have to be flat surfaces. They can also be concave, convex, or prism-shaped, provided that they have the previously specified, complementary configuration.

In order to improve the traction between the drive elements and the circulatingly arranged handrail, an interlocking transmission of the driving force can be provided. For that purpose, tooth profiles, to which the driving force can be transmitted, are preferably formed on the two mutually opposite sides of the inner contour.

As already mentioned, the inner contour is provided with sliding elements, on which guide elements and/or tooth profiles are formed. In the operational state, the guide elements interact with handrail guide means, such as a handrail guide profile or guide rollers, which are arranged on a balustrade of the escalator or the moving walkway. For this purpose, the guide elements can be, for example, guide grooves adjusted to the handrail guide profile. For example, fabric inserts, sliding friction-reducing surface coatings, or inserted sliding elements made, for example, from a suitable polymeric material, such as PTFE (polytetrafluoroethylene) or POM (polyoxymethylene), or from a metal, such as brass or bronze and the like, can be used as sliding elements. Preferably, the guide elements are combined with the sliding elements.

The handrail or the handrail belt is usually made consistently over its longitudinal extension from a soft-elastic elastomeric material, such as SBR (styrene-butadiene rubber), EPM (ethylene-propylene rubber), EPDM (ethylene-propylene terpolymer rubber), NBR (acrylonitrile-butadiene rubber), and the like, wherein tension-bearing elements, such as steel wire strands, carbon fibers, or aramid fiber strands, are embedded in the elastomeric material as reinforcement.

However, it is also possible that the handrail is made of a soft-elastic elastomeric material and the sliding elements are made of a polymer material which is harder than the soft-elastic elastomeric material. In sections, the harder sliding elements are arranged at discrete distances along the longitudinal extension of the handrail and preferably partially embedded in the elastomeric material. The guide elements and/or tooth profiles are formed on the sliding elements. The thus formed handrail belt or handrail has a spine-like structure, so that it has alternating hard- and soft-elastic areas. As a result, the handrail can be easily bent and highly stressed areas, such as sliding surfaces or guide grooves, can be formed on the sliding elements.

In order to also maintain the dimensional stability of the handrail in the longitudinal extension, the sliding elements can be connected to the tension-bearing elements embedded in the soft-elastic elastomeric material.

In order to drive the circulatingly arranged handrail, the drive elements of the handrail-drive system can comprise at least one toothed belt which can be moved in a circulatory manner. In this case, the toothed belt can be in contact with the handrail in order to transmit the driving force to the handrail. The driving force can be transmitted in a purely force-locking manner but is preferably transmitted in a mainly form-locking manner in that a tooth profile complementary to the toothed belt is formed at least on one of the two side surfaces of the inner contour. Since, as described above, the handrail is provided with sliding elements, the two side surfaces with the tooth profiles can also be formed on said sliding elements.

However, the drive elements can also comprise at least one transmission gearwheel, which engages in a corresponding tooth profile of the side surfaces of the inner contour. A multiplicity of arrangements of the drive elements is conceivable, for example, pure toothed belt solutions, pure gearwheel solutions, and combinations of gearwheels and toothed belts.

In one possible arrangement of the drive elements, the toothed belt, with its first run, can be in mesh with the first opposite side of the inner contour, and with its second run, it can be in mesh with the at least one transmission gearwheel. With this arrangement, the movement or rotation direction of the second run can be implemented, so that the circulation direction of the toothed belt runs counter to the direction of rotation of the transmission gearwheel. As a result, the transmission gearwheel can be in mesh with the second opposite side of the inner contour.

In a further possible arrangement of the drive elements, the toothed belt can be guided between and be in operative connection with at least two gearwheels, and so the two gearwheels have an opposing direction of rotation, and the first of the two gearwheels is in mesh with the first opposite side of the inner contour, and the second of the two gearwheels is in mesh with the second opposite side of the inner contour.

For carrying and guiding the handrail which is arranged in a circulating manner, at least one balustrade with a handrail guide means or handrail guide profile is preferably present. At least part of the drive elements can be integrated in the handrail guide means.

The drive elements described above can be driven by an angular gear arranged in the handrail guide means, and a motor, and together they form a handrail drive. Of course, it is also possible that a plurality of such handrail drives is used to drive a single handrail, wherein their speeds must then be matched exactly.

Furthermore, it is not absolutely necessary for all components of the handrail drive to be arranged entirely in the balustrade or in the handrail guide means. For example, the toothed belt can be guided by the handrail guide means through the balustrade, through a balustrade base which connects the balustrade to a supporting structure of the moving walkway or the escalator, and around a drive wheel arranged in the supporting structure. The drive wheel can be driven by the step band or by a motor arranged in the supporting structure.

The handrail-drive system can be used both in an escalator and in a moving walkway. They usually have two balustrades, which are arranged on both sides of a step band or pallet band and each have a circulating handrail. Accordingly, at least two handrail-drive systems are to be provided per escalator or moving walkway.

Embodiments of the present application can be particularly advantageous because the handrail-drive system has a very small configuration and can thus be installed at any point of the balustrade. Due to the circulating arrangement of the handrail, a handrail advance and a handrail return is present, wherein the user can hold on to the handrail in the area of the handrail advance. Depending on the section, very different tensile forces thus act on the handrail. Since the handrail-drive system is not tied to the available installation space, it can be installed at the installation location ideal with regard to the expected load. In an escalator connecting a lower level of a structure to an upper level of a structure, the tensile forces in the handrail advance are highest at the upper level when the escalator conveys from the lower level to the upper level. Therefore, the drive elements are preferably arranged at said upper level.

It must be noted that some of the possible features and advantages of the invention are described herein with reference to different embodiments. A person skilled in the art recognizes that the features can be combined, adapted, or interchanged in a suitable manner in order to arrive at further embodiments of the invention.

BRIEF DESCRIPTION OF THE DRAWINGS

In the following, embodiments shall be described with reference to the attached drawings, wherein neither the drawings nor the description are to be interpreted as delimiting the invention.

The drawings are only schematic and not to scale. In the different drawings, the same reference signs denote the same or identically acting features.

DETAILED DESCRIPTION

Figure 1:
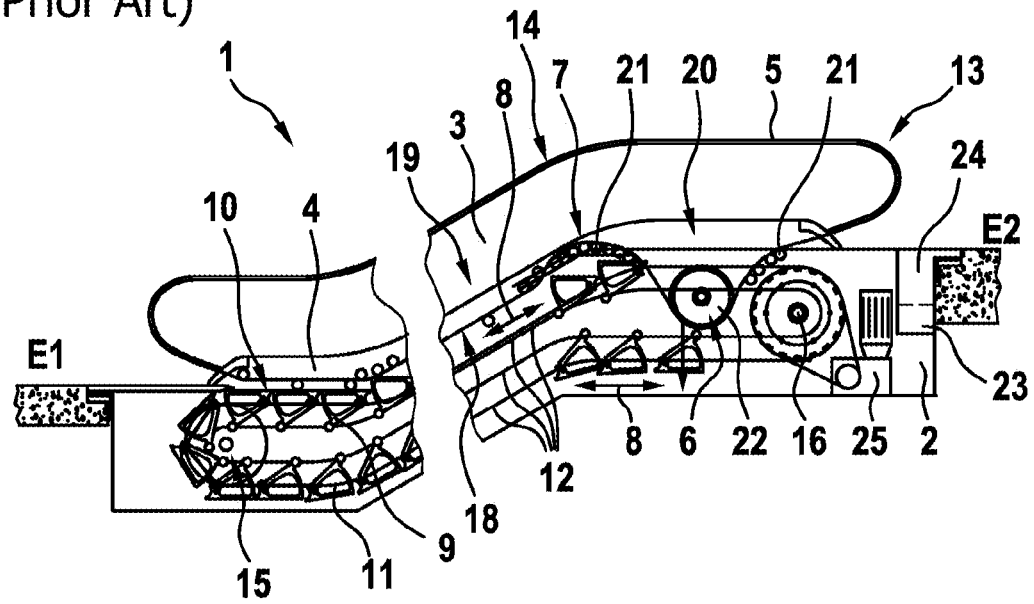
Fig. 1 (Prior Art)
FIG. 1 schematically shows the side view of an escalator with a handrail-drive system according to the prior art.

FIG. 1 schematically shows a side view of an escalator 1 according to the prior art, by means of which persons can be conveyed, for example, between two levels E1, E2. The escalator 1 has a supporting structure 2 in the form of a truss which, for the sake of clarity, is shown only with its contours. The supporting structure 2 accommodates components of the escalator 1 and supports them within a building. These components include, for example, balustrades 3 (due to the side view, only one is visible) having a handrail 5 arranged in a circulatory manner. The balustrades 3 are connected via balustrade bases 4 to the supporting structure 2.

The escalator 1 further comprises two annularly closed, circulating conveyor chains 11, wherein only one is visible due to the side view. The two conveyor chains 11 consist of a multiplicity of chain links. The two conveyor chains 11 can be moved in travel directions along a travel path 8. The conveyor chains 11 run parallel to one another and are spaced apart from one another in a direction transverse to the travel direction. In end areas adjacent to the levels E1, E2, the conveyor chains 11 are deflected by deflection chain wheels 15, 16.

Between the two conveyor chains 11, a plurality of tread elements 9 in the form of steps are arranged, which connect the conveyor chains 11 to one another transversely to the travel path 8. With the help of the conveyor chains 11, the tread elements 9 can be moved in the travel directions along the travel path 8. In this case, the tread elements 9 guided on the conveyor chains 11 form a stepped belt 10, in which the tread elements 9 are arranged one behind the other along the travel path 8 and can be stepped on by users at least in a conveying area 19. The circulating step belt 10 is guided by schematically depicted guide rails 12 and supported against gravity. These guide rails 12 are arranged in the supporting structure 2 in a stationary manner.

In order to be able to move the conveyor chains 11, the chain wheels 16 of the upper level E2 are connected to the drive arrangement 25. The drive arrangement 25 is controlled by means of a control 24 (which, in FIG. 1, is only indicated very schematically). Together with the drive arrangement 25 and the deflection wheels 15, 16, the circulating band 10 forms a conveyor for users and objects, the tread elements 9 of which can be moved relative to the supporting structure 2 which is firmly anchored in the building.

The handrail 5 or the circulating handrail belt 5 is driven by drive elements 6 which, for example, can be operatively connected to the drive arrangement 25 of the escalator 1 in a mechanical manner. The handrail 5 and the drive elements 6 are essential parts of a handrail-drive system 20. If the handrail-drive system 20 has its own motor, a handrail control 23 is also included which, in the present example, is integrated in the escalator control 24. The correct tension of the handrail 5 is maintained by means of an only schematically depicted handrail tensioning device 7.

Figure 2:
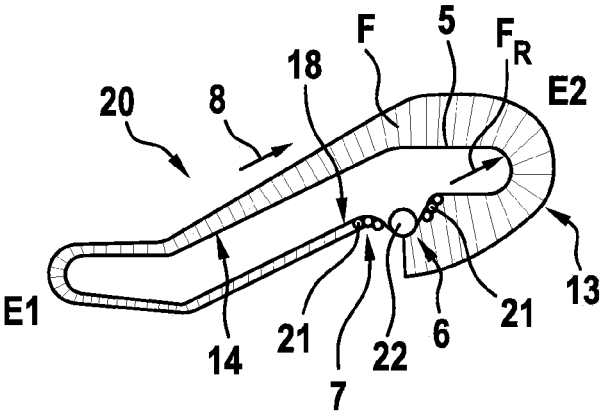
Fig. 2 (Prior Art)
FIG. 2 schematically shows the existing tension profile in the handrail of the escalator shown in FIG. 1.

FIG. 2 schematically shows the tension profile F present in the handrail 5 of the handrail-drive system 20 shown in FIG. 1, wherein the tension profile F is shown over the entire circumference of the handrail 5 and represents the tensile force acting in the longitudinal extension of the handrail 5. For reasons of clarity, only the handrail-drive system 20 with its most essential parts, such as the handrail 5 and the drive elements 6 configured as a friction wheel 22 and guide rollers 21, is shown. In this case, the representation of the tension profile F refers to a travel path 8 conveying from the floor E1 to the floor E2 and to an average load on the handrail 5 by users holding on to it. It is obvious that the tensile force acting in the handrail 5 increases in the handrail advance 14 due to the frictional forces and the users holding on, and that it is highest in the upper floor E2 up to the drive elements 6, while it drops to the level of the preload force in the handrail return 18. As long as there is no change in direction of the handrail, for example, in the straight sections, a high tensile force and thus a high tension is not a problem because they are usually absorbed by one or more tension-bearing elements (not depicted) of the handrail 5. However, in case of changes in direction, for example, in the area of the upper balustrade deflection arc 13, the high tensile forces lead to high radial forces $F_R$, so that the handrail 5 in interaction with handrail guide means (shown in FIGS. 5, 8, 11, and 12) of the balustrade 3 is subject to high wear particularly at these points. In case of a reversed circulation direction of the handrail 5, a slightly different tension profile F is logically to be expected; however, it depends particularly on the frictional forces occurring between the handrail guide means and the guide elements of the handrail 5.

Figure 3:
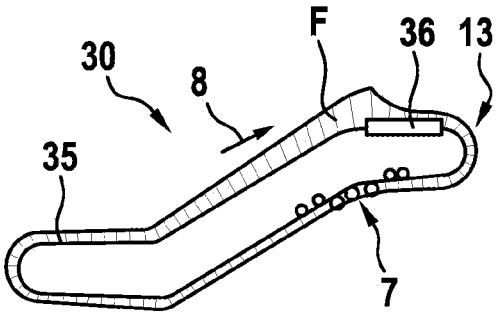
FIG. 3 schematically shows the tension profile present in the handrail of an escalator when the handrail drive of the handrail-drive system is arranged at an ideal position.

FIG. 3 schematically shows a handrail-drive system 30 according to the application with a handrail drive 37 having drive elements 36 and a handrail 35 adjusted to the drive elements 36. Furthermore, the tension profile F present in the handrail 35 is shown, which, at the same travel path 8, differs significantly from the tension profile F of FIG. 2 because the drive elements 36 of the handrail-drive system 30 are arranged at an ideal position. It can be clearly seen that the tensions are reduced to the level of the tension present due to the handrail tensioning device 7 even before the balustrade deflection arc 13. As a result, the wear on the handrail 35 and on the handrail guide means (not depicted) is drastically reduced, and the lifespan of the handrail 35 and the energy consumption of the escalator during operation is significantly reduced.

However, there is also a requirement regarding the aesthetics of the balustrade, particularly a glass balustrade, as is commonly used in escalators and moving walkways for department stores and airports. As a result, only one handrail-drive system 30 with drive elements 36 can be used, which have significantly smaller dimensions than the drive elements 6 of the handrail-drive system 20 shown in FIG. 1.

Figure 4:
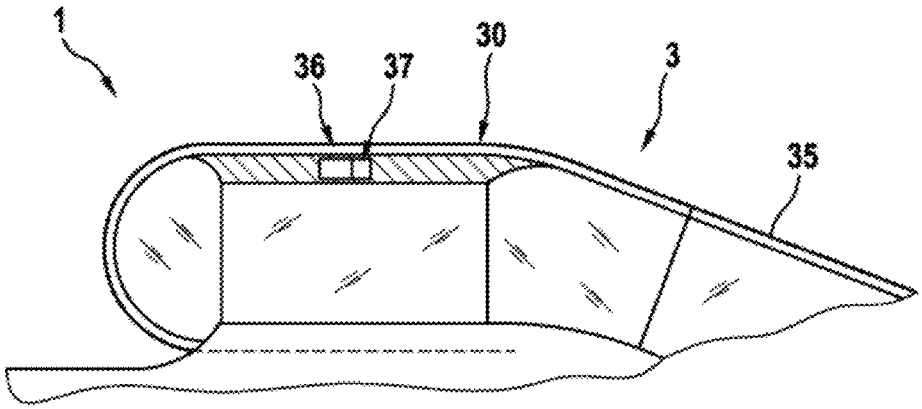
FIG. 4 shows a first embodiment of a glass balustrade of an escalator or a moving walkway with a handrail-drive system, whose handrail drive according to FIG. 3 is arranged at an ideal position in the immediate vicinity of the handrail in the glass balustrade.

As a first embodiment, FIG. 4 shows a section of a glass balustrade 3 of an only partially depicted escalator 1 or a moving walkway 1 with a handrail-drive system 30. According to FIG. 3, its handrail drive 37 with its drive elements 36 is arranged at an ideal position in the immediate vicinity of the handrail 35 in the glass balustrade 3.

Figure 5:
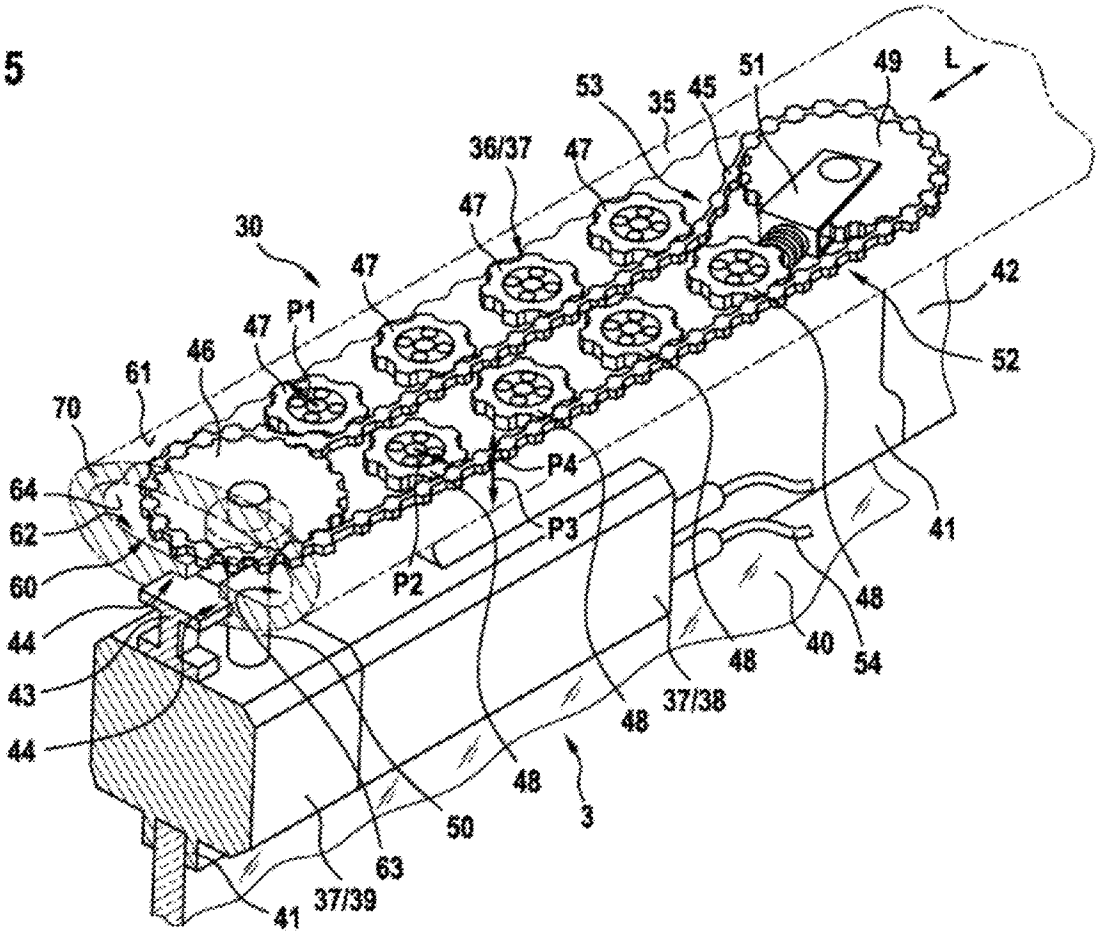
FIG. 5 shows details of the handrail-drive system shown in FIG. 4 in a three-dimensional, larger view.

FIG. 5 shows details of the handrail-drive system 30 shown in FIG. 4 in a three-dimensional, larger view. The handrail-drive system 30 has a handrail drive 37 and a circulating handrail 35, of which only a section is shown in FIG. 5. The handrail drive 37 essentially comprises drive elements 36, a motor 38, and an angular gear 39. In order to better illustrate the structure and the interaction of the handrail 35 with the drive elements 36, the handrail 35 is also shown partially transparent, but for reasons of clarity, embedded sliding elements and tension-bearing elements are not depicted.

The motor 38 and the angular gear 39 are integrated in the glass balustrade 3, wherein the housing is attached by means of corresponding flange lugs 41 to a glass panel 40 of the glass balustrade 3. The motor 38 is connected via electrical lines 54, for example, to the handrail control 23 shown in FIG. 1. Furthermore, the housings have connection points for handrail guide means 42, 43 or handrail guide profiles 42, 43. The drive elements 36 comprise a toothed belt 45, a belt gearwheel 46, transmission gearwheels 47, support gearwheels 48, and a belt tensioning wheel 49. The angular gear 39 has an output shaft 50 which is connected to the belt gearwheel 46. The toothed belt 45 is guided in a circulating manner around the belt gearwheel 46 and the belt tensioning wheel 49 which is spaced apart from the belt gearwheel 46 and which keeps the toothed belt 45 tensioned by means of a tension spring 51. The support gearwheels 48, four in the present embodiment, are arranged in a horizontal plane between the first run 52 and the second run 53 of the toothed belt 45. The transmission gearwheels 47, also four in the present embodiment, are also arranged in the same plane. The transmission gearwheels 47 are driven by the second run 53 of the toothed belt 45, wherein the circulation direction of the toothed belt 45 runs counter to the direction of rotation of the transmission gearwheels 47.

The handrail 35 is delimited by an outer contour 61 configured as a gripping surface and by an inner contour 62 which leaves a cavity 60 free in the handrail 35. The cavity 60 is open toward the surroundings of the handrail 35, and so said handrail 35 has a C-shaped cross-section 70. On the inner contour 62, two mutually opposite side surfaces 63, 64 are present. The two side surfaces 63, 64 each have a tooth profile which extends in the longitudinal extension L of the handrail 35 and has the same tooth profile module as the toothed belt 45 and the transmission gearwheels 47. Furthermore, 62 guide elements 44 are formed on the inner contour, which are adjusted to the handrail guide means 42, 43.

The driving force is transmitted from the drive elements 36 to the handrail 35 at the two mutually opposite side surfaces 63, 64 of the inner contour 62. In order to transmit the driving force, the toothed belt 45 meshes with its first run 52 with the first opposite side surface 63 of the inner contour 62, and the transmission gearwheels 47 mesh with the second opposite side surface 64.

Due to a complementary configuration of the side surfaces 63, 64, all further forces P1, P2, P3, P4, required and/or caused by the transmission of the driving force and acting between the side surfaces 63, 64, are compensated for one another. This means that a complementary configuration of the side surfaces 63, 64 refers to a configuration which, with the exception of the driving force, mutually compensates all the forces P1, P2, P3, P4 acting on side surfaces 63, 64 in the area of the driving force transmission, and so no additional components, for example, pressure rollers known from the prior art, are required. Preferably, the two complementarily configured side surfaces 63, 64 are mirror-symmetrical to one another. In a handrail 35, which is operationally arranged in a circulatory manner, they can be, for example, two side surfaces 63, 64 arranged in vertical planes parallel to one another which mutually support the force P1, P2 or the pressing force required for transmitting the driving force, or, as in the present example, forces P1, P2, P3, P4 generated by tooth edges. With respect to the forces P1, P2 acting on the side surfaces 63, 64, the cross-section 70 of the handrail 35 is preferably configured in a sufficiently deformation-resistant manner, so that said forces P1, P2 do not spread the C-shaped cross-section 70.

Figure 6:
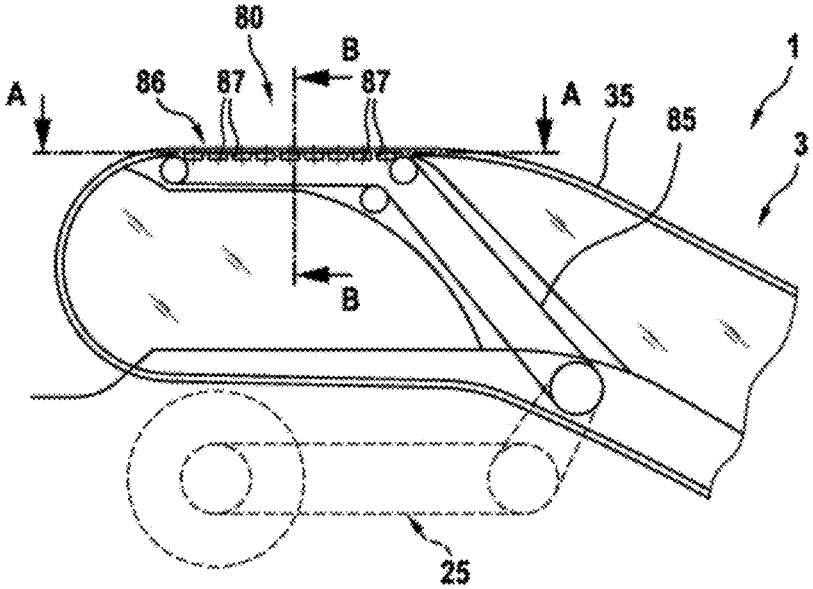
FIG. 6 shows a second embodiment of a glass balustrade of an escalator or a moving walkway with a handrail-drive system, whose drive elements according to FIG. 3 are arranged at an ideal position in the immediate vicinity of the handrail in the glass balustrade, wherein said drive elements are driven by the drive arrangement of the moving walkway or the escalator.

FIG. 6 schematically shows a second embodiment of a glass balustrade 3 of an escalator 1 or of a moving walkway with a handrail-drive system 80, which is arranged in an ideal position analogously to FIG. 3. The handrail-drive system 80 comprises a handrail 35 and drive elements 86 integrated in the glass balustrade 3, wherein the handrail 35 is driven by the drive arrangement 25 of the moving walkway or the escalator 1 shown in FIG. 1.

Figure 7:
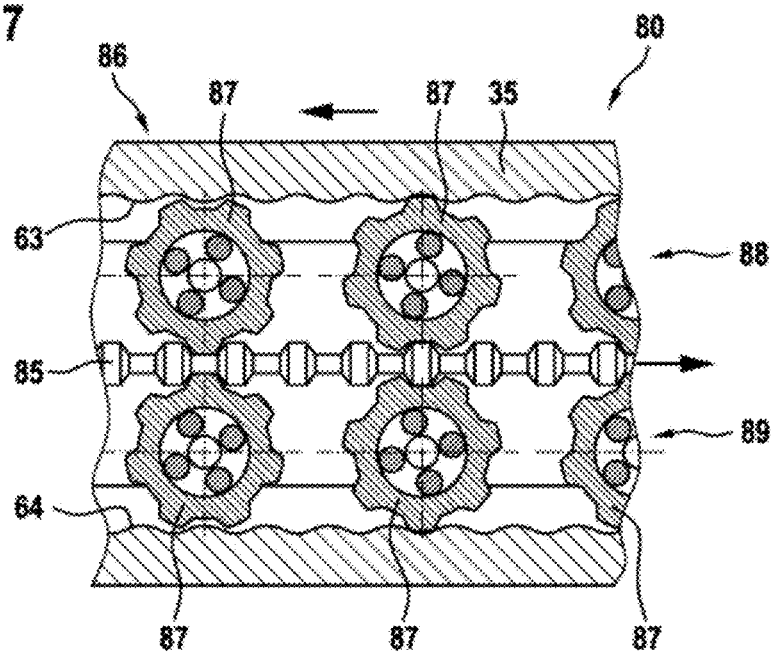
FIG. 7 shows a sectional plan view of some of the drive elements arranged in the handrail of the handrail-drive system shown in FIG. 6.

FIG. 7 shows the section A-A indicated in FIG. 6 in an enlarged view with part of the drive elements 86 arranged in the handrail 35 of the handrail-drive system 80 shown in FIG. 6.

Figure 8:
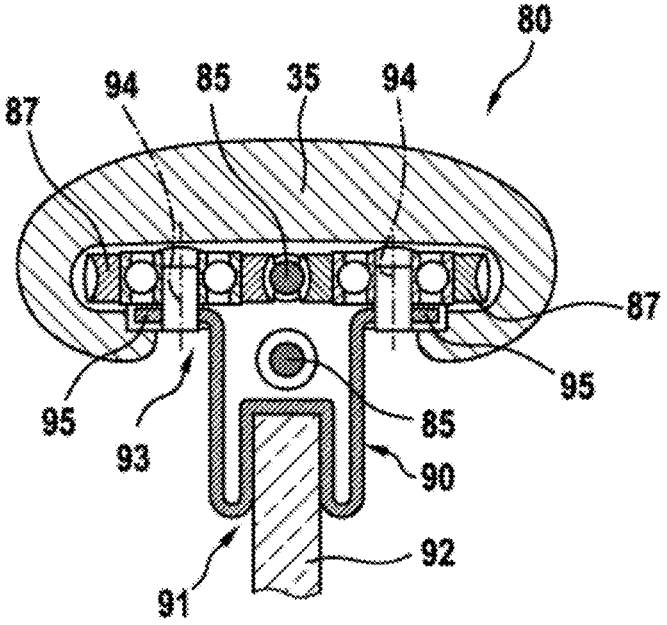
FIG. 8 shows a section of the cross-section of the handrail-drive system shown in FIGS. 6 and 7.

FIG. 8 shows the section B-B indicated in FIG. 6 in an enlarged view of the handrail-drive system 80 depicted in FIGS. 6 and 7.

In the following, FIGS. 6 to 8 shall be described jointly, wherein, for reasons of clarity, embedded sliding elements and tension-bearing elements are once again not depicted in these drawings. Since the handrail 35 is driven by the drive arrangement 25, sketched out as a broken line, a mechanical connection must exist between the drive elements 86 and the drive arrangement 25. In this case, a toothed belt 85 of the drive elements 86 is arranged in a circulating manner between the drive arrangement 25 and further drive elements 86. In order to ensure that the toothed belt 85 can be bent in different directions, its teeth are configured, similar to a string of pearls, rotationally symmetrical to the central longitudinal axis of the toothed belt 85. The further drive elements 86 comprise transmission gearwheels 87 which are arranged in two rows 88, 89 in a horizontal plane in a handrail guide means 90 or a handrail guide profile 90 of the glass balustrade 3. Since the toothed belt 85 is guided between the two rows 88, 89, the transmission gearwheels 87 of the two rows have an opposing direction of rotation. The transmission gearwheels 87 transmit the driving force of the toothed belt 85 in a form-locking manner onto the two side surfaces 63, 64 of the handrail 35. The handrail guide means 90 is made, for example, by means of a plurality of folds from a sheet metal strip and with its underside 91 can be fitted onto a glass panel 92 of the glass balustrade 3. The axes 94 of the transmission gearwheels 87 are attached to its upper side 93, and guide elements 95 are formed.

Figure 9:
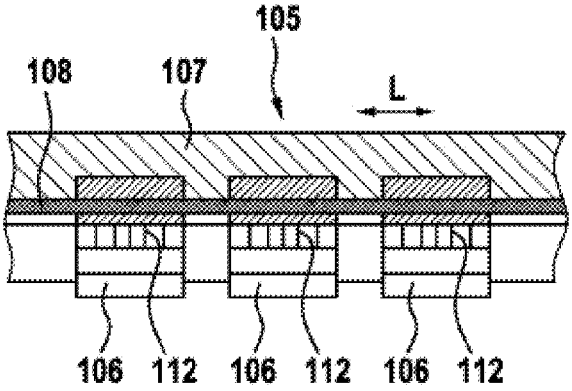
FIG. 9 shows a sectional view of a section of a possible configuration of the handrail with sliding elements.
Figure 10:
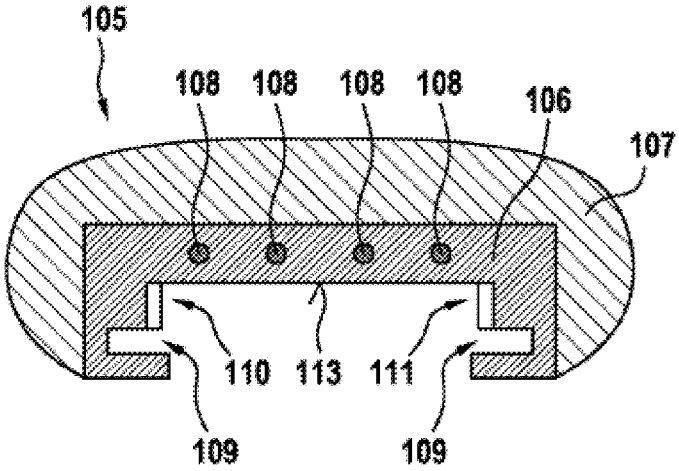
FIG. 10 shows the cross-section of the handrail with sliding elements shown in FIG. 9.

FIGS. 9 and 10 show a sectional view of a section of a possible configuration of a handrail 105, and its cross section. The handrail 105 or handrail belt is usually made consistently over its longitudinal extension from a soft-elastic elastomeric material 107, such as SBR (styrene-butadiene rubber), EPM (ethylene-propylene rubber), EPDM (ethylene-propylene terpolymer rubber), NBR (acrylonitrile-butadiene rubber), and the like, wherein tension-bearing elements 108, such as steel wire strands, carbon fibers, or aramid fiber strands, are embedded in the elastomeric material 107 as reinforcement.

Furthermore, sliding elements 106 are partially embedded in the elastomeric material 107 of the handrail 105, which are harder than the soft-elastic elastomeric material 107. The sliding elements 106 can be made of a hard-elastic polymer material or a non-ferrous metal, which have a low coefficient of friction with other materials such as steel. Such materials can be, for example, PTFE (polytetrafluoroethylene), POM (polyoxymethylene), brass, or bronze, and the like.

In sections, the harder sliding elements 106 are arranged at discrete distances along the longitudinal extension L of the handrail 105. The thus formed handrail 105 or handrail belt has a spine-like structure, so that it has alternating hard- and soft-elastic areas along its longitudinal extension L. As a result, the handrail 105 can be easily bent, and highly stressed areas such as sliding surfaces 113 and/or guide grooves can be formed on the sliding elements 106. In the present embodiment, the sliding elements 106 are provided with guide elements 109 configured as grooves. In the operational state, the guide elements 109 interact with handrail guide means which are arranged on a balustrade 3 of the escalator 1 or the moving walkway, such as the handrail guide profile 90 shown in FIG. 8. Furthermore, the two side surfaces 110, 111 provided for the driving force transmission are also formed on the sliding elements 106. For a safe force transmission, tooth profiles 112 or tooth profile sections 112, which are adjusted to the drive elements (not depicted), are formed on the side surfaces 110, 111.

In order to also maintain the dimensional stability of the handrail 105 in its longitudinal extension, the sliding elements 106 are connected to the tension-bearing elements 108 embedded in the soft-elastic elastomeric material 107.

Figure 11:
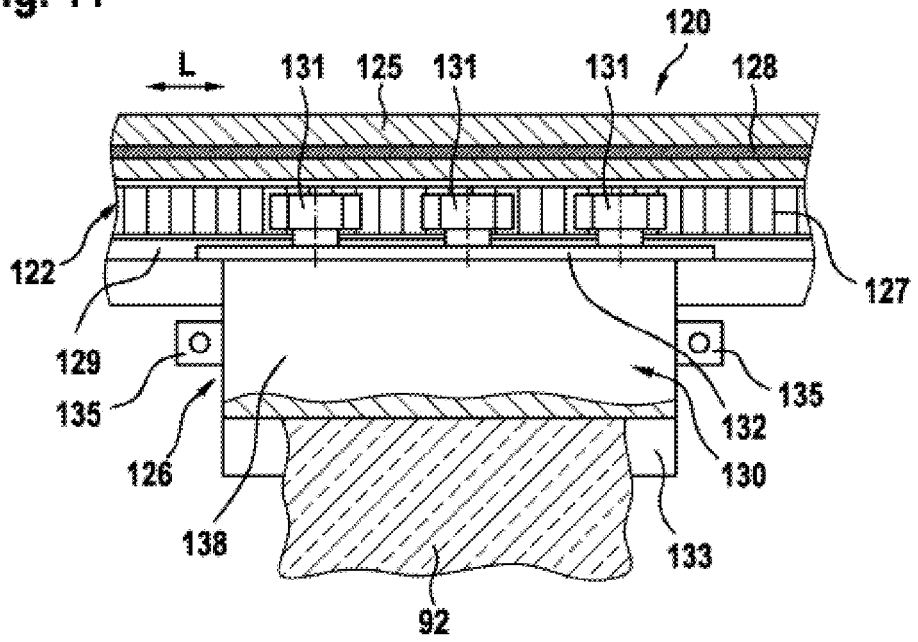
FIG. 11 shows a sectional view of a section of a further possible configuration of a handrail-drive system, wherein the handrail has a central ridge, on which the two side surfaces are formed.
Figure 12:
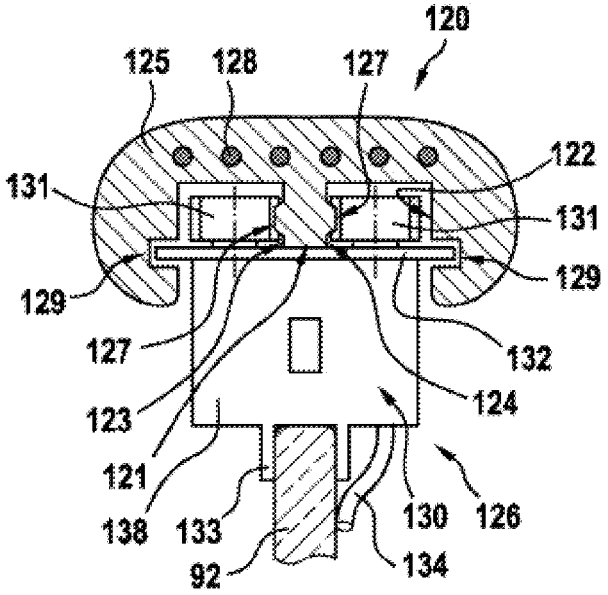
FIG. 12 shows the cross-section of the handrail-drive system shown in FIG. 11.

FIG. 11 shows a sectional view of a section of a further possible configuration of a handrail-drive system 120 which comprises a handrail 125 and drive elements 126. FIG. 12 shows the cross-section of the handrail-drive system 120 shown in FIG. 11.

In the above-described embodiments of FIGS. 4 to 12, the two side surfaces 63, 64, 110, 111 of the handrail 35, 105 are arranged on the two mutually opposite sides of the inner contour 62 of the two legs of the U-shaped or C-shaped cross-section.

As the embodiment of FIGS. 11 and 12 shows, a handrail-drive system 120 is also possible with a handrail 125, whose inner contour 122 has a center ridge 121 which extends in the longitudinal direction L of the handrail 125, and on which the two side surfaces 123, 124 are formed on the two mutually opposite sides of the central ridge 121 or the inner contour 122. The side surfaces 123, 124 need not necessarily be flat, vertical surfaces. They can also be concave, convex or prism-shaped, as long as they have the complementary configuration specified above. Furthermore, tension-bearing elements 128 are embedded in the elastomeric material of the handrail 125 and arranged on the inner contour 122 in the longitudinal extension L of the handrail as guide elements 129 configured as grooves.

In order to improve the traction between the drive elements 126 of the handrail-drive system 120 and the handrail 125, which is arranged in a circulatory manner, an interlocking transmission of the driving force is provided, and so, on the two mutually opposite sides of the inner contour 122, tooth profiles 127 are formed, to which the driving force can be transferred.

The drive elements 126 comprise six transmission gearwheels 131 which are arranged in pairs, wherein the central ridge 121 is guided between the individual gearwheel pairs, and so the teeth of the transmission gearwheels 131 mesh with the tooth profiles 127 of the handrail 125. The other components of the drive elements 126, such as the motor and transmission parts, by means of which the transmission gearwheels 131 are driven, are housed together as a handrail drive 130 in a drive housing 138 and therefore not visible. Handrail guide means 132 and flange lugs 133 are formed on the drive housing 138. With the flange lugs 133, the drive housing 138 can be attached to a glass panel 92 of the glass balustrade 3. This creates a solid base for the handrail guide means 132, on which the guide elements 129 of the handrail 125 are guided. The drive housing 138 can further comprise connection points 135 to handrail guide means (not depicted) of the balustrade 3. The motor arranged in the drive housing 138 is connected via electrical lines 134, for example, to the handrail control 23 shown in FIG. 1. Of course, the handrail control 23 can also be integrated in the drive housing 138.

Although the invention has been described by way of depicting specific embodiments, it is obvious that numerous further embodiments can be created with the knowledge of the present invention, for example, by combining the features of the individual embodiments and/or interchanging individual functional units of the embodiments. For example, the handrail 125 shown in FIGS. 11 and 12 can also have sliding elements, such as in the handrail 105 shown in FIGS. 9 and 10, wherein the center ridge 121 is then formed either on the sliding elements or on the soft-elastic elastomeric material. For reasons of clarity, a depiction of signal transmission means, power supply lines, and the like in FIGS. 1 to 4 and 6 has largely been forgone. However, they must inevitably be present in order to ensure that the escalator 1 or the moving walkway 1 can be used in a trouble-free manner with the handrail-drive system 30, 80, 120 according to the invention. Accordingly, correspondingly configured escalators 1 are included within the scope of the present claims.

Finally, it should be noted that terms such as "having," "comprising," etc., do not exclude other elements or steps, and terms such as "a" or "an" do not exclude a multitude. Reference signs in the claims are not to be interpreted as delimiting.

The invention claimed is:

1. A handrail-drive system for an escalator or a moving walkway, the handrail-drive system comprising:

a handrail drive with drive elements; and a belt-form handrail configured to be moved in a circulatory manner, wherein the handrail is delimited by:

an outer contour that is configured in the form of a gripping surface, and an inner contour that leaves a cavity free in the handrail, and wherein the cavity is open toward the surroundings of the handrail, wherein a driving force is transmitted from the drive elements to the handrail on two mutually opposite side surfaces of the inner contour, wherein, due to a complementary configuration of the side surfaces, and with the exception of the driving force, all other forces which are caused by the transmission of the driving force act between the side surfaces compensate for one another, wherein the handrail is made of a soft-elastic elastomeric material and comprises sliding elements made of a polymer material which is harder than the soft-elastic elastomeric material, wherein, in sections, the sliding elements are arranged at discrete distances along the longitudinal extension of the handrail, and guide elements or tooth profiles are formed on the sliding elements.

2. The handrail-drive system according to claim 1, wherein the handrail has a U-shaped or C-shaped cross-section along its longitudinal extension.

3. The handrail-drive system according to claim 1, wherein tooth profiles, to which the driving force can be transmitted in a force-locking or form-locking manner, are formed on the two mutually opposite side surfaces of the inner contour.

4. The handrail-drive system according to claim 1, wherein the handrail comprises tension-bearing elements embedded in the soft-elastic elastomeric material, and wherein the sliding elements are connected to the tension-bearing elements.

5. The handrail-drive system according to claim 1, wherein the drive elements comprise at least one toothed belt which can be moved in a circulatory manner.

6. The handrail-drive system according to claim 1, wherein the drive elements comprise at least one transmission gearwheel.

7. The handrail-drive system according to claim 5, wherein the toothed belt, with a first run, is in mesh with the first opposite side surface of the inner contour, and with a second run, is in mesh with the at least one transmission gearwheel, wherein a circulation direction of the toothed belt runs counter to a direction of rotation of the transmission gearwheel, and wherein the transmission gearwheel is in mesh with the second opposite side surface of the inner contour.

8. The handrail-drive system according to claim 5, wherein the toothed belt is guided between and in operative connection with at least two transmission gearwheels, the two transmission gearwheels having opposing directions of rotation, and the first of the two transmission gearwheels is in mesh with the first opposite side surface of the inner contour, and the second of the two transmission gearwheels is in mesh with the second opposite side surface of the inner contour.

9. The handrail-drive system according to claim 5, wherein at least one balustrade with a handrail guide device is present, and wherein at least part of the drive elements is integrated in the handrail guide device.

10. The handrail-drive system according to claim 9, wherein the toothed belt is guided by the handrail guide device through the balustrade, through a balustrade base which connects the balustrade to a supporting structure of the moving walkway or the escalator, and around a drive wheel arranged in the supporting structure.

11. The handrail-drive system according to claim 9, wherein the toothed belt is driven by an angular gear arranged in the handrail guide device and a motor.

12. An escalator or moving walkway comprising:

at least one handrail-drive system according to claim 1.

13. The escalator according to claim 12, wherein:

the escalator connects a lower level of a structure to an upper level of the structure, and due to a circulating arrangement of the handrail, a handrail advance and a handrail return is present, and the drive elements are arranged in the advance of the upper level.

14. The handrail-drive according to claim 3, wherein the handrail comprises tension-bearing elements embedded in the soft-elastic elastomeric material, and wherein the sliding elements are connected to the tension-bearing elements.

15. The handrail-drive system according to claim 4, wherein the drive elements comprise at least one toothed belt which can be moved in a circulatory manner.

16. The handrail-drive system according to claim 5, wherein the drive elements comprise at least one transmission gearwheel.

* * * * *